US005951353A

United States Patent [19]

Moore

[11] Patent Number: 5,951,353

[45] Date of Patent: Sep. 14, 1999

[54] DISK FOR THROWING AND ROLLING

[76] Inventor: David Denny Moore, 1055 S. Elizabeth St., Denver, Colo. 80209

[21] Appl. No.: 09/054,792

[22] Filed: Apr. 3, 1998

[51] Int. Cl.[6] ..... A63H 27/00

[52] U.S. Cl. ..... 446/46; 446/5; 446/247

[58] Field of Search ..... 446/46, 48, 236, 446/5, 247; 473/588, 594

[56] References Cited

U.S. PATENT DOCUMENTS

| | | | |
|---|---|---|---|
| 4,216,611 | 8/1980 | Psyras | 446/46 |
| 4,351,129 | 9/1982 | Kerkenbush | 446/46 |
| 4,919,083 | 4/1990 | Axelrod | 119/710 |
| 4,940,441 | 7/1990 | Novinsky | 446/46 |
| 5,351,967 | 10/1994 | Yang | 273/348.2 |
| 5,540,610 | 7/1996 | Sneddon | 446/46 |
| 5,544,619 | 8/1996 | Braun | 119/474 |
| 5,672,087 | 9/1997 | De La Paz Rizo | 446/46 |
| 5,799,616 | 9/1998 | McClung | 119/709 |

FOREIGN PATENT DOCUMENTS

| | | | |
|---|---|---|---|
| 2250212 | 3/1992 | United Kingdom | 446/46 |

*Primary Examiner*—Robert A. Hafer
*Assistant Examiner*—Kurt Fernstrom
*Attorney, Agent, or Firm*—Jennifer L. Bales; Macheledt Bales & Johnson LLP

[57] ABSTRACT

A disk for throwing or rolling is formed of a central disk shaped core attached to a top and bottom pad assembly. The core includes a slot extending inward from its periphery for the insertion of an accelerator strap. The core includes a plurality of cavities, into which may be inserted plugs of various materials. The disk will possess different characteristics depending upon the composition of the plugs, and where they are placed. Wooden plugs may be used to cause the disk to float, metal plugs may be used to increase the weight of the disk, or porous plugs may be impregnated with scent to train dogs to retrieve. The placement and number of each type of plug affects the performance of the disk.

11 Claims, 3 Drawing Sheets

DISK FOR THROWING AND ROLLING

BACKGROUND OF THE INVENTION

1. Field of the Invention

The present invention relates to a disk for throwing and rolling, for use in exercising animals and playing games.

2. Description of the Prior Art

Dog owners often give their pets exercise by throwing a stick or a Frisbee for the dog to retrieve. Unfortunately, the owner can only throw these objects a short distance, and thus is often tired long before the dog is. Similarly, owners of hunting dogs need to teach the dogs to retrieve objects representing downed birds or the like. Again, the short distance the object can be thrown is often a disadvantage.

Even people who don't own dogs like to go to the park and get exercise and enjoyment out of throwing and catching frisbees. Variations on simply playing catch with throwing toys include Frisbee golf and ultimate Frisbee. These games are limited by the short distance a Frisbee can be thrown and its limited accuracy.

A need remains in the art for a throwing/rolling toy capable of being propelled further and more accurately than conventional throwing toys.

SUMMARY OF THE INVENTION

It is an object of the present invention to provide a throwing/rolling toy capable of being propelled further and more accurately than conventional throwing toys. The disk is propelled either by hand or with the assistance of an accelerator strap wound around the parameter of the disk.

A toy according to the present invention comprises a disk shaped core forming a plurality of cavities, and a removable top element and a removable bottom element attached to the top and bottom surfaces of the core, for covering said cavities. The top element and the bottom element are padded. The top element, the bottom element, and the core each form a hole running from the top of the top element through the bottom of the bottom element, and a cross bolt through the hole attaches the top element, the bottom element, and the core. A coin slot is provided in one end of the cross bolt for loosening said cross bolt.

A plurality of plugs are provided for removable insertion into the cavities of the core. The plugs may be formed of a material lighter than water to permit the toy to float. The plugs may also be formed of metal to increase the weight of the toy. Or, the plugs may be porous to permit the introduction of a scent into the plug, for training dogs to retrieve.

The core further forms a slot extending from the periphery of the core toward the axis, for the insertion of an acceleration strap for throwing the toy.

DETAILED DESCRIPTION OF THE PREFERRED EMBODIMENT

Figure 1:
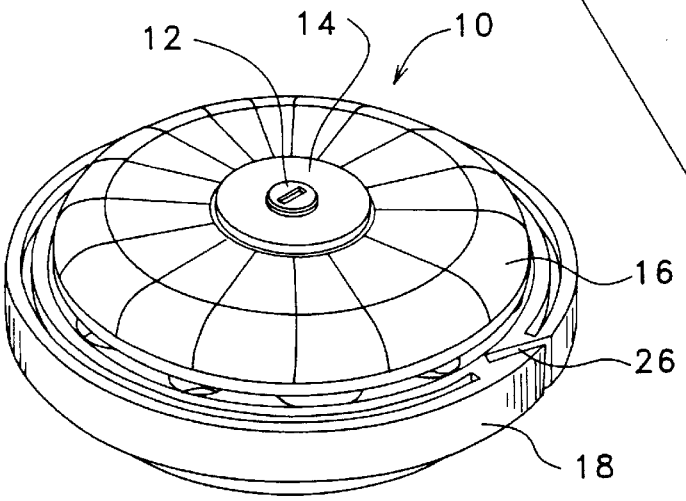
FIG. 1 shows an isometric view of a throwing/rolling disk according to the present invention.

FIG. 1 shows an isometric view of throwing/rolling disk 10 according to the present invention. Preferably disk 10 is formed of a central core 18 attached to a top and bottom pad assembly 16 (see FIG. 3 for detail). Core 18 includes a slot 26 for the insertion of an accelerator strap 40 as shown in FIG. 4.

Figure 4:
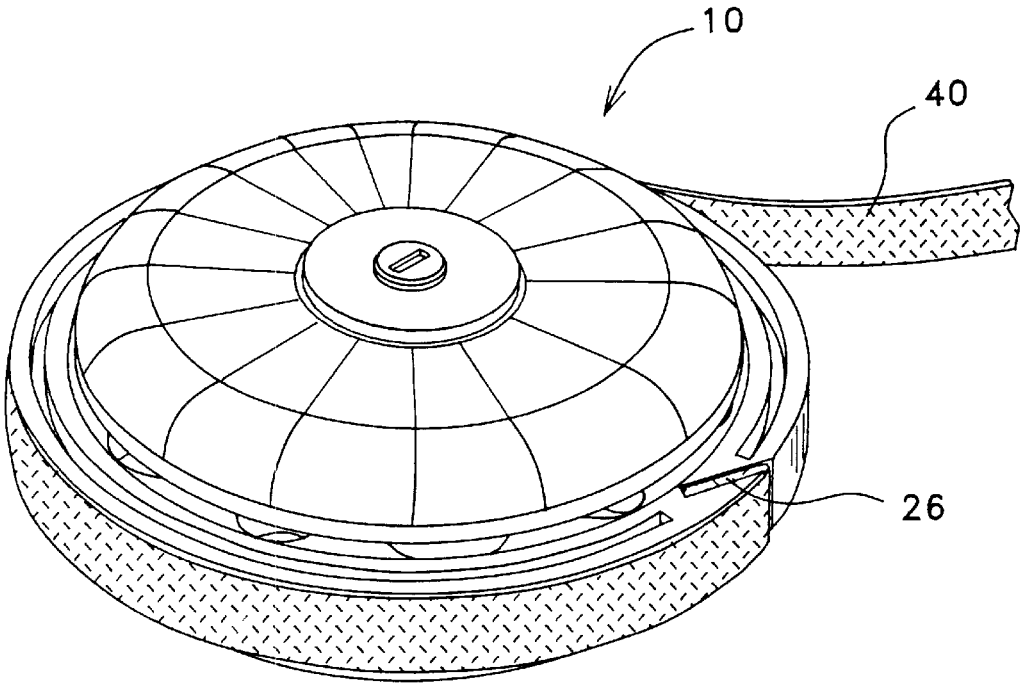
FIG. 4 shows the disk of FIG. 1 in use with an accelerator strap.

There are two ways the disk can be launched: by hand, or by using an accelerator strap 40 (as shown in FIG. 4).

When launched by hand, the disk is held in either hand and either rolled along the ground, or skipped across the surface of a body of water. The techniques and types of grip on the disk can be varied for best results by the user. When rolled across the ground (as with a bowling ball), a distance of up to 50 yards can be achieved over mowed grass. Much greater distances can be achieved when rolled over hard dirt, or a paved surface. When launched with accelerator strap 40, distances over mowed grass exceed 150 yards.

Figure 2:
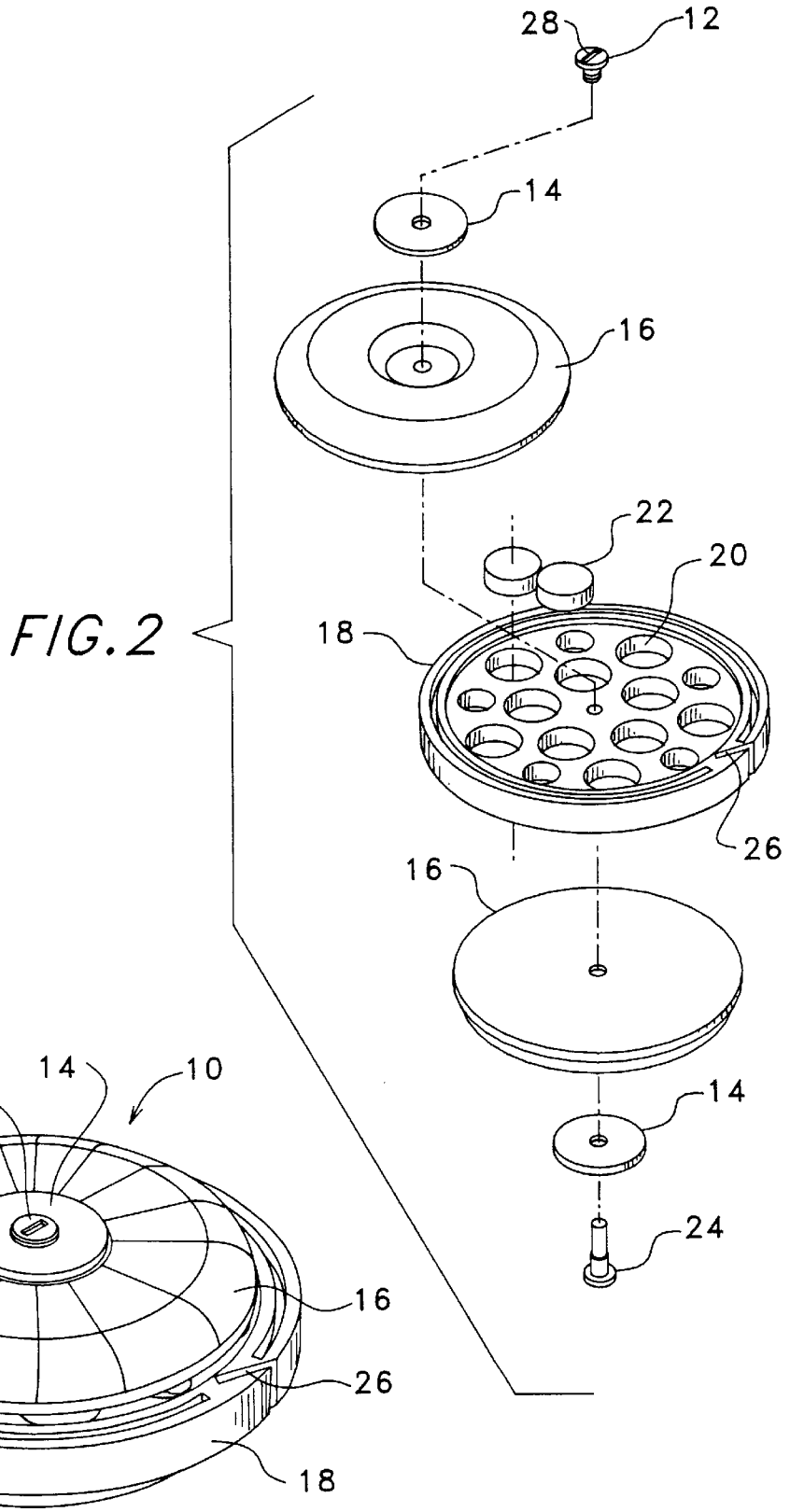
FIG. 2 shows an exploded view of the throwing/rolling disk of FIG. 1.
Figure 5:
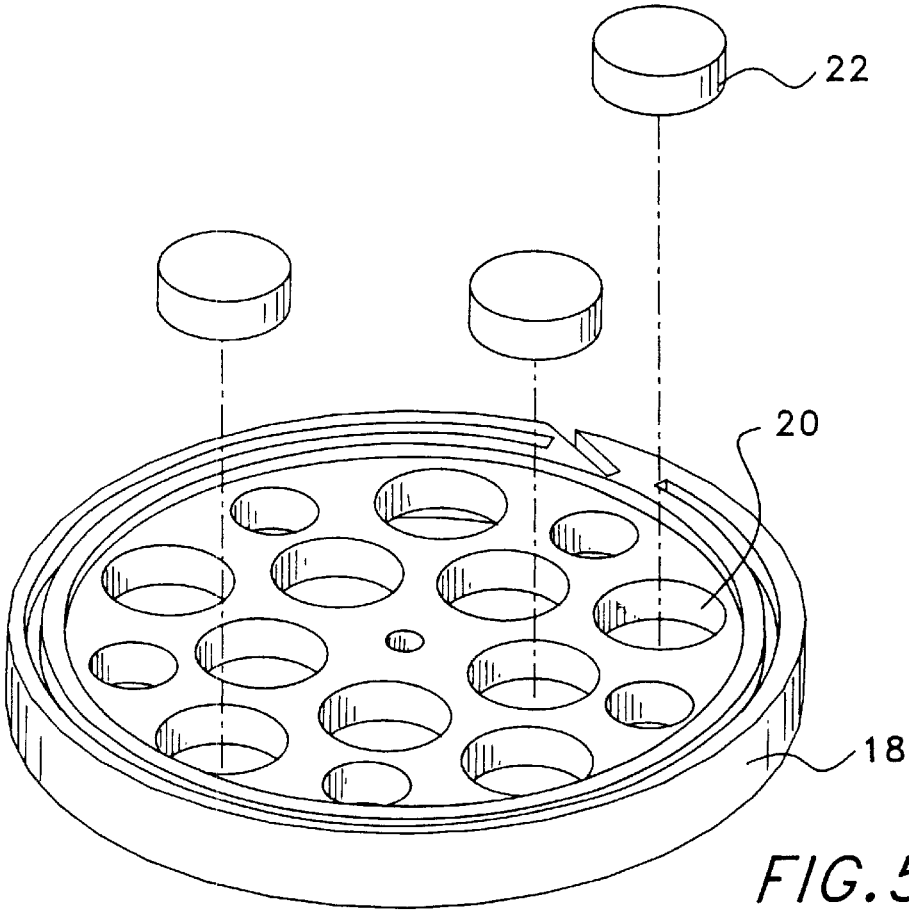
FIG. 5 shows the core of the disk of FIG. 1 and plugs for use in the core in more detail.

When skipping over water (cork or wood plugs may be inserted as shown in FIGS. 2 and 5 to assist buoyancy), a back handed throw works well. The disk will then skip like a flat rock across the surface of the water.

FIG. 2 shows an exploded view of disk 10. Disk 10 is put together as follows. Plugs 22 of various materials are optionally inserted into holes 20 of core 18. Top and bottom pad assemblies 16 are attached to core 18 via cross bolt 12, 24 and washers 14. Plugs 22 are retained in their holes 20 by pad assemblies 16. In the preferred embodiment, cross bolt portions 12 and 24 are each formed with a coin slot 28, so that disk 10 may be easily disassembled in the field and reconfigured (e.g. by inserting plugs of different materials into holes 20 in core 18).

In the preferred embodiment, core 18 includes 10 large holes and five small holes 20. The use of various plugs 22 is described in detail in the summary of the invention and the description of FIG. 5. Disk 10 will possess different characteristics depending upon the composition of the plugs, and where they are placed.

Disk 10 is preferably about seven inches in diameter and about two inches thick. It weighs about a pound with no plugs 22 inserted into holes 20. The weight may increase to three pounds when ten plugs 22 of a heavy metal such as steel or lead are inserted.

Figure 3:
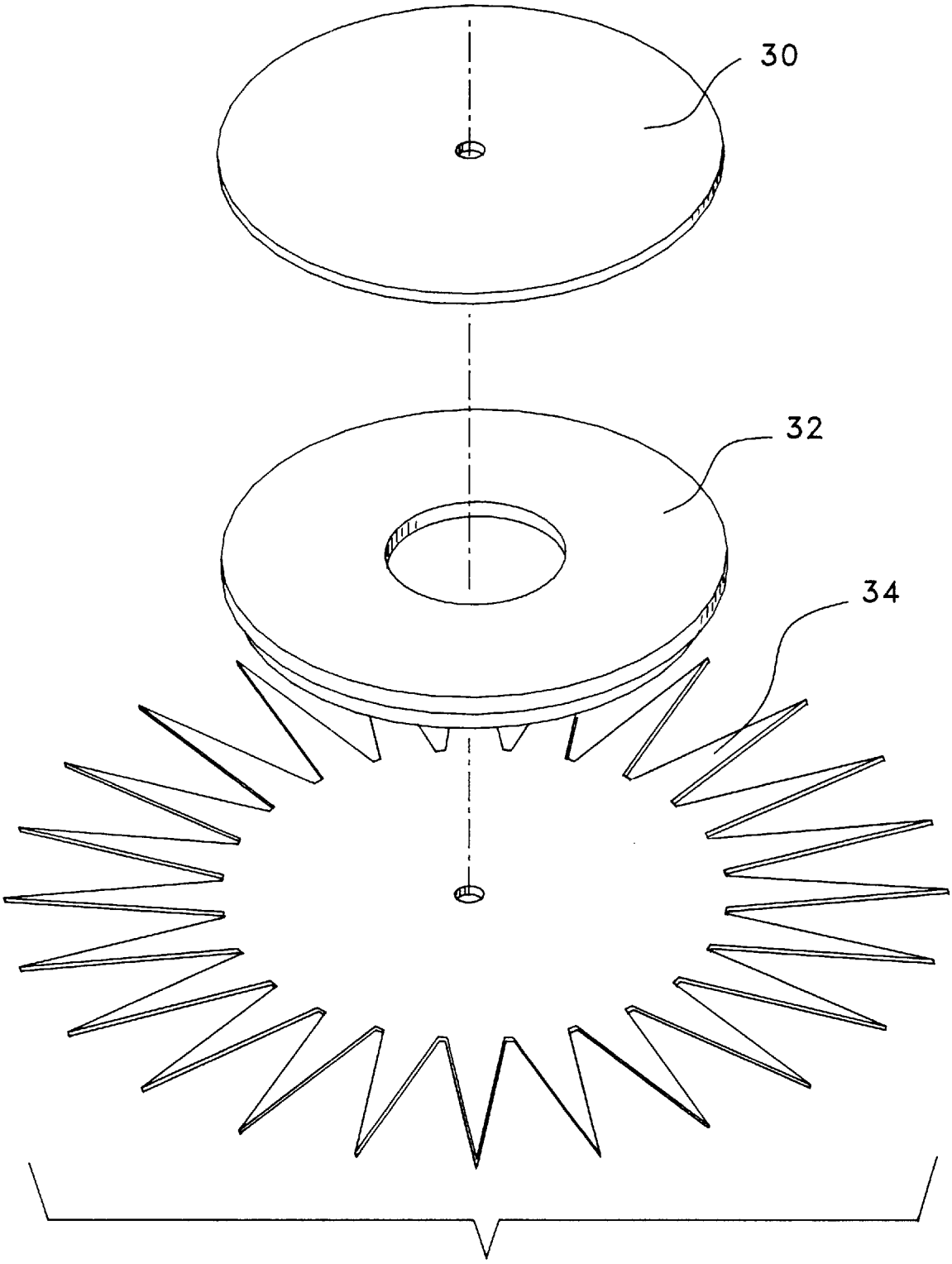
FIG. 3 shows an exploded view of one of the top or bottom pad assemblies on the exterior of the disk of FIG. 1.

FIG. 3 shows an exploded view of pad assembly 16. Each pad assembly 16 comprises a thin circular plate or washer disk 30, a pad 32, and a cover 34. Cover 34 encases washer disk 30 and pad 32 to form pad assembly 16. Washer disk 30 is preferably formed of ⅛ inch plastic or metal, and has a ¼ inch hole in the center. Pad 32 is preferably ¾ inch fiber pad (E.G. Carpet pad) with a 2 inch hole in the center. Cover 34 is preferably formed of heavy cotton/nylon canvas wrapped around pad 32 and washer disk 30 and glued to disk 30. For example, spray contact cement is sprayed on one side of disk 30, pad 32 is placed on the other side of pad 30, and cover 34 is wrapped around both, affixing to the sticky side of disk 30.

FIG. 4 shows disk 10 in use with accelerator strap 40. One end of strap 40 is inserted into slot 26, and strap 40 is wrapped around the perimeter of core 18. When the disk owner throws or rolls disk 10, pulling on strap 40 at the right moment imparts a strong spin to disk 10. The use of accelerator strap 40 greatly increases the distance the disk can be rolled.

Accelerator strap 40 is preferably formed of woven nylon or the like. The strap is approximately one inch in width, and about three to four feet in length. One end of strap 40 is inserted into slot 26 provided on the outside parameter of core 18 of disk 10. Strap 40 is then wrapped around the parameter of core 18, overlapping itself. The pressure of the wrap holds the strap end in the slot. Disk 10 is then placed in the throwing hand and the running end of the strap is held between the last two fingers against the palm of the hand (a bead or loop on one end of the strap may be provided as a stop to assist in this effort), and the disk is held with the first two fingers and thumb on opposite sides of the disk, gripping the pads.

The disk is thrown forward with a bowling motion. Once the disk leaves the hand, the hand and arm continue upward still holding onto accelerator strap 40. The forward motion of the disk from the throw provides resistance so that once it leaves the hand the strap unwinding will impart a significant spin to the disk 10 while it is still in the air. Once the disk 10 hits the ground it will be propelled not only by the force of the hand throw, but will also by the rapid forward spinning imparted by the unwinding of the accelerator strap 40. When rolled across the ground using the accelerator strap 40, a distance of up to 150 yards can be achieved over mowed grass.

FIG. 5 shows core 18 of disk 10, and plugs 22 for use in holes 20 of core 18. Plugs 22 may be composed of a variety of different materials, depending upon how disk 10 is to be used. Typically, wood. Porous fiber, or metal plugs 22 are used as described in the following examples.

1. For use as an exercising and training tool for dogs:

The disk can be configured for different situations when used as an exercise tool or training tool for dogs. This device can be used on grass or dirt fields or on water. The ability to change the characteristics enables a person to increase the weight of disk 10 to accustom an animal to retrieving a heavy object, or to make disk 10 buoyant to train an animal to retrieve from water, or to impart a scent to disk 10 to train a dog to retrieve from a blind scent trail. The performance of the disk 10 can become effected also by changing the configuration, (performance elements affected include the length of the throw (retrieve), and the behavior of the disk 10 as it completes its run, i.e. wobble, smooth, right curve, left curve, straight roll. Examples follow.

EXAMPLE (1)

If holes 20 are left empty, the disk 10 can be thrown or rolled by any method and will be light weight, and possess smooth and regular characteristics when rolled across a field of exercise of play.

EXAMPLE (2)

Holes 20 are filled with plugs 22 of porous material exposed to one of a variety of animal scents, giving the disk 10 when thrown the ability to leave an animal scent trail that can be easily followed by a tracking animal to the place where the disk 10 stops its forward progress. With these porous plugs 22, the disk 10 can be thrown by any method and will be light weight, and possess smooth and regular characteristics when rolled across a field of exercise of play.

EXAMPLE (3)

If holes 20 in core 18 are filled with plugs 22 of heavy metal, the gross mass of the disk 10 will be increased. With these heavy plugs 22, the disk 10 can be thrown or rolled further, as its mass will increase inertia. The increased weight can also be used to train an animal to retrieve a heavier object without changing the outside physical dimensions of the disk 10. If the heavy metal plugs 22 are placed in the holes 20 in specific patterns leaving some of the holes 20 empty or filled with lighter plugs 22, the disk 10 when thrown will perform with predictable but unusual roll patterns across the field on which it is rolled.

EXAMPLE (4)

If holes 20 are filled with plugs 22 of wood or cork material, the disk will extend its ability 10 to float on water indefinitely. The disk 10 can be thrown horizontally onto the water with great spin, allowing it to skip great distances on the water. When it comes to rest, the wooden plugs will allow it to float 22 high in the water so that it can be easily seen and retrieved by a retrieving dog.

2. For use as a throwing disk game to be played on a large field:

When used as a game the object is to roll the disk 10 the length of a field of play and have it pass through two flags placed some distance apart to score a point. The disk 10 is thrown (rolled), either by hand or with an accelerator strap 40, by one player the length of a field of play. The field of play can be ether a grass/dirt field or hard surface field, and the length can be determined by the skill of the players. The flags are placed some distance apart, so that the opening between the flags comprises a target or goal through which the player attempts to roll the disk 10. The game is designed to be competitive between two individuals, or teams of players. A player (or team) may be positioned at opposite ends of the field by the goal, as in the game of horseshoes.

The disk 10 can be configured by each player as they choose using different plugs 22 to produce desired effects, as described above. I.e., the disk 10 can be made heavier, or lighter, etc., by each player prior to the beginning of the match.

While the exemplary preferred embodiments of the present invention are described herein with particularity, those skilled in the art will appreciate various changes, additions, and applications other than those specifically mentioned, which are within the spirit of this invention.

What is claimed is:

1. A toy for throwing or rolling comprising:

a disk shaped core having a top surface and a bottom surface and forming at least one cavity in the top surface;

a removable top element attached to the top surface of the core, said top element covering said cavity; and a discrete plug for removable insertion into the cavity, wherein the plug is formed of a material lighter than water to permit the toy to float.

2. The toy of claim 1 wherein said cavity extends through the bottom surface of said core and further including:

a removable bottom element attached to the bottom surface of the core, said bottom element covering said cavity.

3. The toy of claim 2, wherein the top element and the bottom element are padded.

4. The toy of claim 3, wherein the top element, the bottom element, and the core each form a hole running from the top of the top element through the bottom of the bottom element, and further including:

a cross bolt through the hole for attaching the top element, the bottom element, and the core.

5. The toy of claim 4, wherein the cross bolt includes a coin slot for loosening said cross bolt.

6. A toy for throwing or rolling comprising:

a disk shaped core having a top surface and a bottom surface and forming at least one cavity in the top surface;

a removable top element attached to the top surface of the core, said top element covering said cavity; and a discrete plug for removable insertion into the cavity;

wherein the core further forms a slot extending from the periphery of the core toward the axis, and further including an acceleration strap for insertion into said slot and for wrapping around the periphery of the disk.

7. A toy for throwing or rolling comprising:

a disk shaped core forming a plurality of cavities;

a removable top element attached to the top surface of the core, said top element covering said cavities;

a removable bottom element attached to the bottom surface of the core, said bottom element covering said cavities; and a plurality of discrete plugs for removable insertion into the cavities; wherein the plugs are formed of a material lighter than water to permit the toy to float.

8. The toy of claim 7, wherein the top element and the bottom element are padded.

9. The toy of claim 8, wherein the top element, the bottom element, and the core each form a hole running from the top of the top element through the bottom of the bottom element, and further including:

a cross bolt through the hole for attaching the top element, the bottom element, and the core.

10. The toy of claim 9, wherein the cross bolt includes a coin slot for loosening said cross bolt.

11. The toy of claim 7, wherein the core further forms a slot extending from the periphery of the core toward the axis, and further including an acceleration strap for insertion into the slot.

* * * * *

UNITED STATES PATENT AND TRADEMARK OFFICE

CERTIFICATE OF CORRECTION

PATENT NO. : 5,951,353

DATED : September 14, 1999

INVENTOR(S) : Moore et al.

It is certified that error appears in the above-identified patent and that said Letters Patent is hereby corrected as shown below:

Column 2, line 48, delete "E.G. Carpet" and insert --e.g. carpet--.

Column 3, line 14, after 'hits the ground', insert --,--.

Column 3, line 15, after 'throw, but will also', insert --be propelled--.

Column 3, line 24, after 'wood', delete ". Porous" and insert --, porous--.

Column 3, line 37, delete "throw (retrieve" and insert --throw/retrieve--.

Column 3, line 56, after 'field of exercise', delete "of" and insert --or--.

Column 4, line 6, after 'the disk', insert -- 10--.

Column 4, line 6, after 'extend its ability', delete " 10".

Column 4, line 9, after 'wooden plugs', insert -- 22--.

Column 4, line 10, after 'to float', delete " 22".

Column 4, line 15, after 'as a game', insert --,--.

Signed and Sealed this

Twenty-third Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,951,353
DATED : September 14, 1999
INVENTOR(S) : Moore, et. al.

It is certified that error appears in the above-identified patent and that said Letters Patent is hereby corrected as shown below:

Heading, beneath 'United States Patent', after 'Moore', insert --et al.--.

First page, after 'Inventor: David Denny Moore... Denver, Colo. 80209', insert --; Jonathan Matthew Moore, 4010 Renn Hart Hills Road, Loves Park, Ill. 61111--.

Column 2, line 48, delete "E.G. Carpet" and insert --e.g. carpet--.

Column 3, line 14, after 'hits the ground', insert --,--.

Column 3, line 15, after 'throw, but will also', insert --be propelled--.

Column 3, line 24, after 'wood', delete ". Porous" and insert --, porous--.

Column 3, line 37, delete "throw (retrieve" and insert --throw/retrieve--.

Column 3, line 56, after 'field of exercise', delete "of" and insert --or--.

Column 4, line 6, after 'the disk', insert -- 10--.

Column 4, line 6, after 'extend its ability', delete " 10".

Column 4, line 9, after 'wooden plugs', insert -- 22--.

Column 4, line 10, after 'to float', delete " 22".

UNITED STATES PATENT AND TRADEMARK OFFICE

CERTIFICATE OF CORRECTION

PATENT NO. : 5,951,353

DATED : September 14, 1999

INVENTOR(S) : Moore, et. al.

It is certified that error appears in the above-identified patent and that said Letters Patent is hereby corrected as shown below:

Column 4, line 15, after 'as a game', insert --,--.

Signed and Sealed this

Twenty-fourth Day of October, 2000

*Attest:*

Q. TODD DICKINSON

*Attesting Officer*

*Director of Patents and Trademarks*